US005635663A

United States Patent [19]

Krieger et al.

[11] Patent Number: 5,635,663

[45] Date of Patent: Jun. 3, 1997

[54] FIREARM WITH INTERCHANGEABLE MODE DETERMINATOR

[75] Inventors: Hubert Krieger, Schramberg-Waldmössingen; Norbert Fluhr, Oberndorf, both of Germany

[73] Assignee: Heckler and Koch, Oberndorf/Neckar, Germany

[21] Appl. No.: 199,183

[22] PCT Filed: Jun. 24, 1993

[86] PCT No.: PCT/EP93/01623

§ 371 Date: Jul. 6, 1994

§ 102(e) Date: Jul. 6, 1994

[87] PCT Pub. No.: WO94/00728

PCT Pub. Date: Jan. 6, 1994

[30] Foreign Application Priority Data

Jun. 25, 1992 [DE] Germany ..... 42 20 922.6

[51] Int. Cl.[6] ..... F41A 19/46

[52] U.S. Cl. ..... 89/142; 89/148; 42/69.03; 42/70.08

[58] Field of Search ..... 89/128, 132, 140, 89/142, 148; 42/69.03, 70.04, 70.05, 70.06, 70.08

[56] References Cited

U.S. PATENT DOCUMENTS

| | | | |
|---|---|---|---|
| 2,383,487 | 8/1945 | Johnson, Jr. . | |
| 4,208,947 | 6/1980 | Hillberg | 89/148 |
| 4,619,062 | 10/1986 | Johnson | 42/70.11 |
| 4,679,487 | 7/1987 | Houseman | 89/140 |
| 4,697,495 | 10/1987 | Beretta | 89/143 |
| 5,088,222 | 2/1992 | Larson | 42/70.04 |
| 5,267,407 | 12/1993 | Bornancini | 42/70.08 |
| 5,303,494 | 4/1994 | Tuma et al. | 42/70.04 |

FOREIGN PATENT DOCUMENTS

| | | |
|---|---|---|
| 658 382 | 3/1938 | Germany . |
| 1453913 | 7/1969 | Germany . |

*Primary Examiner*—Michael J. Carone
*Assistant Examiner*—Christopher K. Montgomery
*Attorney, Agent, or Firm*—Cohen, Pontani, Lieberman, Pavane; Christa Hildebrand

[57] ABSTRACT

A firearm, for example a semiautomatic weapon, in particular an automatic pistol, has control elements for controlling several operation or adjustment functions of the weapon. By means of an easily exchangeable functional element, for example a cam disk, it is possible to determine which operation or adjustment function, among all functions made possible by the weapon control elements, the user can set at his weapon. The functional element and/or a component for holding the functional element is designed and arranged in such a way that it can not only be easily fitted in and removed from the firearm not disassembled or only disassembled into its main parts, but also replaced by another type of functional element.

10 Claims, 8 Drawing Sheets

FIG. 1
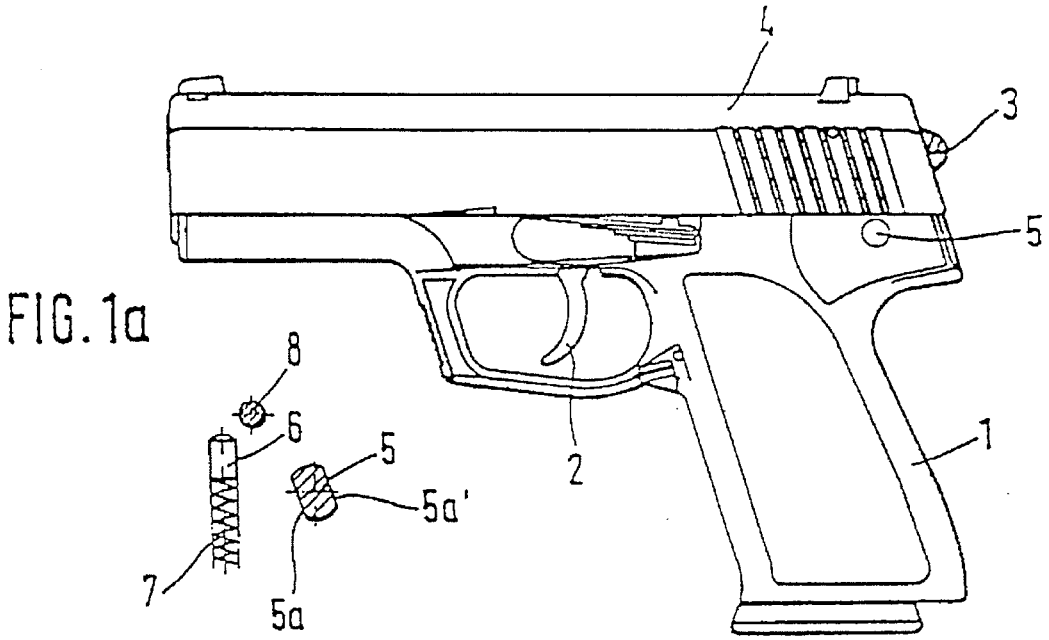
FIG. 1a
FIG. 2
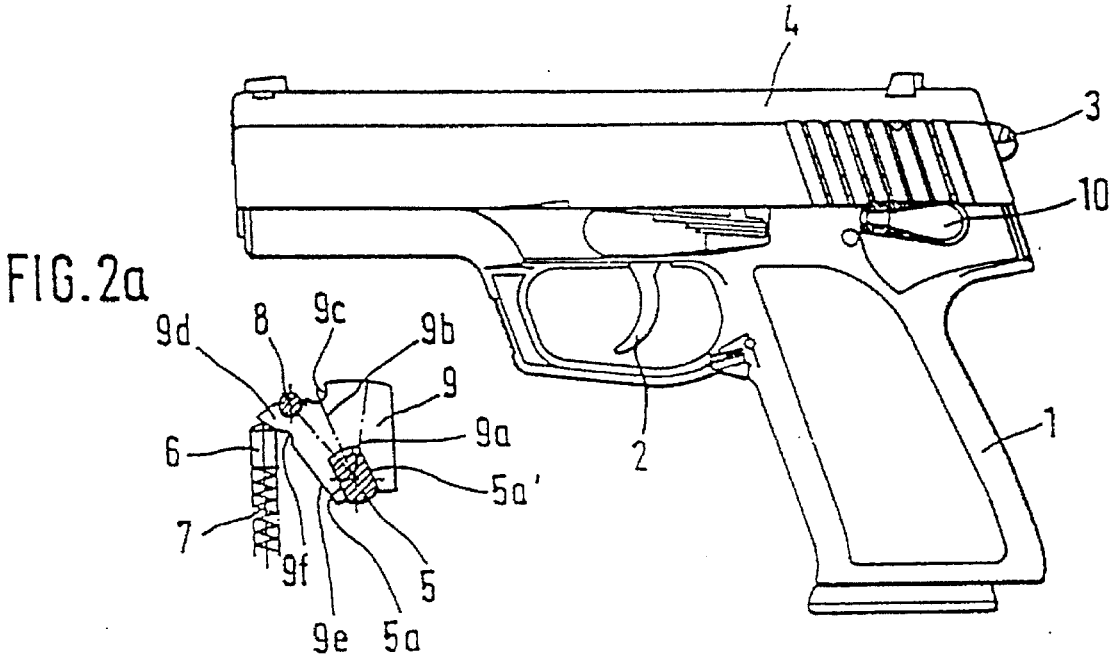
FIG. 2a

FIREARM WITH INTERCHANGEABLE MODE DETERMINATOR

BACKGROUND OF THE INVENTION

1. Field of the Invention

The invention concerns a firearm, especially a semiautomatic weapon and preferably a semiautomatic pistol. The weapon incorporates an interchangeable component, a mode determinator, that determinates what and how many modes the weapon can be maneuvered and employed in. The maneuver-and-employment mode determinater activates components permanently integrated into the weapon. These components operate the weapon in the particular maneuver-and-employment mode selected.

2. Discussion of the Prior Art

A weapon of a specific basic design may not infrequently be employed for various purposes. A particular application, pertinent legislation, or training for a particular objective can necessitate various modes of maneuver and employment. Modifying rapid-tire military weapons for civilian use to prevent continuous or burst-by-burst firing for example is known.

Again, many military applications, reconnaissance for example, may require firing one round at a time or, at the most, in brief bursts and not continuous or running fire. The risk of betraying a position or running out of ammunition for instance may outweigh other considerations.

Semiautomatic pistols for non-military applications may also be employed for a number of special purposes that require specific maneuver-and-employment modes.

Many contemporary semiautomatic pistols with spring-loaded triggers conventionally remain ready once they have been cocked or once there is a shell in the chamber, and require little force on the trigger to overcome its resistance. Such pistols can often be dangerous when their users, mounted police for example, are exposed to jolting while firing.

Although safety mechanisms to prevent unintended firing are an advantage, they can often represent a hazard in some applications by preventing the user from responding rapidly enough to save his life.

Some trainees being tested for rapid-response firing on the range cheat by secretly cocking their weapons ahead of time.

A spring-loaded trigger, finally, is unnecessary for sporting meets with semiautomatic-hammer weapons or with self-loading revolvers. The untensioned hammer indicates unreadiness to fire while the weapon is down or the manual of arms is being executed, although only when the weapon does not have a spring-loaded trigger.

In all of these situations, a semiautomatic pistol conventionally equipped with a safety mechanism, spring-loaded trigger, and the potential for firing with the hammer cocked is less practical than a weapon that can be fired with only a spring-loaded trigger, without a safety mechanism, or only with the hammer cocked.

As hereintofore mentioned, leaving out unneeded components while assembling the weapon and inserting other types of part instead are known. One example is the civil version of a military weapon that lacks a rapid-fire capability.

It is also basically possible to remove the safety mechanism from many weapons without impeding their operation in general. The procedure does, however, require considerable skill, special tools, and a lot of time. Components to occupy the missing safety mechanism's accommodation opening and outlet are also necessary.

Replacing a repeater trigger assembly that accommodates a simple trigger with one that accommodates a hair trigger is also known. Such a procedure, however, can be carried out only by a gunsmith or other skilled craftsman. It has nothing to do with the possibly temporary adaptation of a weapon for a particular application.

SUMMARY OF THE INVENTION

With the hereintofore described state of the art as a point of departure, the present invention addresses a simple means of adapting a weapon of the aforesaid type, especially a semiautomatic, pistol, to various applications.

This object is attained in accordance with the invention, wherein a firearm, especially a semiautomatic weapon or a semiautomatic pistol is disclosed which incorporates an interchangeable component, the mode determinator, which dictates what and how many modes the weapon can be maneuvered and employed in and which activates components permanently integrated into the weapon, which operate the weapon in the particular maneuver-and-employment mode selected, whereby the particular mode determinator, a component it is mounted on, and the permanently integrated components are designed to allow the mode determinator to be removed and optionally replaced with a different type while the weapon is completely assembled or only disassembled into the major subassemblies and without interfering with the permanently integrated components in any way. In other words, the design of the permanently integrated operating components, of the maneuver-and-employment mode determinators, and of the component that the mode determinator is mounted on ensures that the latter can be replaced, especially with another type of mode determinator, without having to partly or entirely disassemble the weapon and without having to interfere with the permanently integrated operating components.

The maneuver-and-employment mode determinator accordingly constitutes a module or a modular firing-mode determinator. It can be removed from the weapon by very simple means, at very low expenditure, and without special tools. It can either not be replaced or it can be replaced by a similar module that determines a different maneuver-and-employment mode. The permanently integrated interacting components of the weapon that the mode determinator or components collaborate with in operating it in the particular mode remain unaltered inside the weapon.

The pistol assembly that usually accommodates the maneuver-and-employment mode determinator is the grip. It does not need to be completely replaced to switch to another mode. Even the shaft (to be understood herein as a rotating cylindrical power-transmission component and not as a handle or stock) that the mode determinator is conventionally mounted on, the same shaft the base of the hammer is attached to for instance, does not need to be replaced. All that is necessary when an appropriate mode determinator is employed is for the replacement or replacements to be manufactured simultaneously without extra expenditure and supplied along with the weapon.

All that is necessary to rapidly actuate the appropriately designed permanently integrated interacting components already present in the weapon, a pistol for example, so that it can be used alone or in conjunction with others in various maneuver-and-employment modes is to simply interchange the mode determinators.

Anyone supplied with such a weapon constructed and shipped in accordance with the present invention can accordingly adapt the weapon to his current situation and requirements on his own. The maneuver-and-employment mode determinator appropriate for a particular application can be inserted in service weapons by an officer before they are issued.

A semiautomatic pistol from which a defective cocking piece can be removed and replaced with a new and intact piece by hand and without any tools is admittedly already known (the Tokarev 34). This procedure, however, simply facilitates maintenance of a specific component. Shifting from one maneuver-and-employment mode to another is neither intended nor possible.

It is in many situations an advantage for the maneuver-and-employment mode determinator to be mounted fight on a shaft that can be manually rotated by a weapon-state selection lever to various extents and accordingly determinate various maneuver-and-employment modes. The lever will preferably be similar to a conventional safety catch resting flat against the outside of the weapon in an ergonomically practical position. It will be conventionally secured to the end of the shaft and extend radially away from it. This embodiment accordingly exploits known and proven features.

The manual control in another embodiment of the invention is mounted directly on the maneuver-and-employment mode determinator. This approach eliminates any play between the component and the shaft that might make it inconvenient to manipulate the manual control. The mode determinator can for example be a sector-shaped cam and the manual control might be a pin projecting out from it through an arc-shaped slot in the wall of the part of the weapon that accommodates the shaft. This part is preferably the grip. The manual control can also be more or less L-shaped with the free end of the base secured to the outer edge of the mode-determination cam. The base of the L will be long enough to ensure that the upright will be far enough away from the cam to overlap the adjacent wall of that part of the weapon (e.g. the grip). The free end of the upright, finally, rests facing the end of the shaft on the outside of the part.

It is preferable for the shaft to be accommodated in the rear of the grip. When the pistol includes a hammer, the base of the hammer can be mounted on the same shaft. The shaft can alternatively be just in front of and parallel with the grip, possibly where the safety-mechanism shaft is in many known semiautomatic pistols.

When the weapon has a known type of state-selection lever, preferably in the form of a tab resting flat against the side of the grip, secured conventionally to the end of and accordingly rotating a shaft accommodated in the same part of the weapon, and accordingly also pivoting a mode-determination cam, or eccentric plate, mounted tight on the shaft, one section of the shaft will preferably not be round, and the cam will slide radially onto that section of the shaft. The shaft will remain integrated into the weapon whether a cam is mounted on it or not and will always occupy the bores that accommodate it.

Part of the outer edge of the maneuver-and-employment mode determinator, the cam, in the advanced version of this embodiment constitutes a positioning contour with catches, preferably notches. The notches are distributed along the contour at various radii of the shaft, at various points along the are of the cam, that is, and secure the shaft at various rotations.

The mode-determinating cam could in principle of course alternatively pivot on the shaft, in which event the surfaces where the cam and the shaft are in contact would be round. The various rotations would in this event be executed by the cam instead of the shaft.

The notches could basically alternatively be positioned in the power train between the firing-pin spring and the trigger. They could for example lift the rod that connects the trigger to the hammer or striker against perhaps the force of a spring until the notch is disengaged. They could alternately perhaps impede the advance of the trigger until it loses its effectiveness as a release, without of course affecting the function of the interrupter. Since such a notch can also lift and disengage the rod, the mode-determinating cam can also act as a safety mechanism or inhibit the rods motion toward the trigger for the same purpose. A notch that extends farther along the contour, more than 30° that is, can be used to release the firing-pin spring.

Interchangeable maneuver-and-employment mode determinators of the type hereintofore described, specifically cams that can be mounted on a shaft and with part of their circumference constituting a positioning contour with notches, allow simple and cost-effective manufacture and a wide range of settings.

Another preferred embodiment of the present invention is intended to make it possible to employ a mode-determinating cam with less eccentricities. Such a cam will be easier to accommodate in the weapon. The notches in the outer edge of this cam are shallower, and the cam itself is mounted radially on the shaft subject to the force of a spring. The notches in the positioning contour can accordingly easily be engaged in sequence, and the force exerted by the spring will simultaneously maintain them securely engaged. A compression spring, especially one that is strictly a detent spring, is particularly preferable. Another version of this embodiment includes at least one catch between its outer edge and vertex rather than on the outer edge. If all the notches are between the outer edge and the vertex, the positioning contour as a whole will be in that vicinity, possibly in the form of a slot with the notches distributed along one side.

The spring in another embodiment will be positioned where one component of its force will be tangential to the pivoting motion of the preferably sectorial mode-determinating cam. The cam will in this event have an elevation at the end of its outer edge for the spring to engage.

The notches in the various mode-determinating cams featured in the further embodiments of the present invention can be designed and positioned to permit the states safety on, safety off, safety off and hammer uncocked, hammer uncocked, etc.

The notches are preferably engaged by a bolt accommodated stationary inside the weapon, paralleling and remote from the shaft. This is a particularly simple design.

If the weapon in accordance with the present invention has no mode-determinating cam, it should have no manual control. The manual control will accordingly also be connected with the weapon's overall controls such that it can easily be removed and replaced.

The weapon in accordance with the present invention can, as hereintofore mentioned, be fitted and refitted as desired with the simple accessories shipped along with it. The principle in accordance with the present invention can be applied to particular advantage in the manufacture of weapons. Weapons maneuvered and employed in differing maneuver-and-employment modes will accordingly differ only in their mode determinator, with respect to the mode-determinating cam, that is, in the case of the automatic pistols just described.

It is also possible to manufacture undifferentiated weapons and finish them in the form of the particular model ordered, by inserting a specific maneuver-and-employment mode determinator just before they are shipped. This approach will considerably reduce warehousing expenditures. Furthermore, trained and experienced personnel will not be needed for assembly.

BRIEF DESCRIPTION OF THE DRAWINGS

Embodiments of the present invention will now be specified by way of example with reference to the enclosed drawing, wherein FIG. 1 is a side view of a weapon in accordance with the present invention in the form of an automatic pistol, FIG. 1*a* is a section along a vertical longitudinal plane through the rear of the pistol illustrated in FIG. 1, FIG. 2 is a side view of the pistol illustrated in FIG. 1 but with the mode-determinating cam and state-selection lever installed, FIG. 2*a* is a section similar to that in FIG. 1*a* through the pistol illustrated in FIG. 2 and illustrating the cam, FIG. 4*a* is a section similar to that in FIG. 2*a* through part of the pistol illustrated in FIG. 4 and illustrating the second version of the cam, FIG. 5*a* is a section similar to that in FIG. 4*a* through part of the pistol illustrated in FIG. 4 and with the third version of the cam in the same setting, FIG. 6*a* is a section similar to that in FIG. 5*a* through part of the pistol illustrated in FIG. 5 and illustrating the cam in the second setting, FIG. 7*a* is a section similar to that illustrated in FIG. 5*a* and illustrating the cam in the third setting, FIG. 11*b* illustrates the same embodiment of the pistol in the same position but with the trigger mechanism in place and with the cam left out, FIG. 12*b* is a section similar to that in FIG. 12*a* with the trigger mechanism in and the cam out.

DESCRIPTION OF THE PREFERRED EMBODIMENT(S)

Figure 3:
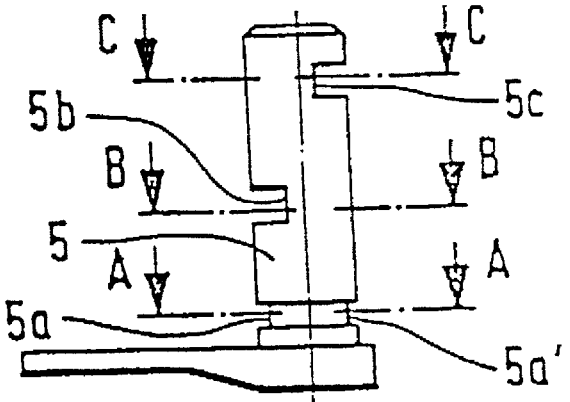
FIG. 3 is a top view of a safety mechanism for the pistol.

Similar parts are labeled with the same numbers throughout the figures. The components are reduced in scale but otherwise extensively realistic. Unless otherwise specified, the parts, especially the mode-determinating cam and its associated components, have their illustrated shapes. Attention is directed in particular to FIGS. 2*a*, 4*a*, 5*a*, 6*a*, and 7*a*, all of which are essentially the same scale larger than FIGS. 2, 4, 5, 6, and 7. The embodiment illustrated in every figure is oriented in the same direction as the embodiments illustrated in all the other figures.

FIGS. 1 through 10 all illustrate basically the same type of semiautomatic pistol, with a trigger 2 and rotating shaft 5 accommodated in its grip 1. Shaft 5 is perpendicular to the plane of projection with one end mounted in each wall of grip 1.

Connected to grip 1 is a slide 4 that accommodates a barrel.

The hammer 3 or 3' in the embodiment illustrated in FIGS. 1 and 2 is a striker 3 with no spur. The hammer 3' in the embodiment illustrated in FIGS. 4 through 8 on the other hand is spring-loaded and has a spur that extends up and to the rear as long as the trigger is uncocked.

The discussion will, to facilitate comprehension, be initially confined to the embodiment illustrated in FIGS. 2 and 2*a*.

The midsection of shaft 5 is not round and has two parallel flat sides 5*a* and 5*a'*. A mode-determinating cam 9 fits over the shaft at this section by way of a matching radial slot 9*a*.

Mode-determinating cam 9, which is illustrated from the side, is in the shape of a sector. Slot 9*a* is introduced at the vertex of the sector and extends more or less along its bisector. Along the outer edge of cam 9, along the arc of the sector, that is, is a contour that accommodates notches 9*c*. Notches 9*c* are designed and positioned to be engaged by a stationary bolt 8. Bolt 8 is accordingly remote from, parallel with, and more slender than shaft 5. Projecting out of one end of the outer edge of the cam, the end to the left in the figures, is a cog 9*d*. The left edge 9*e* of the cam, the left radius of the sector, that is, has a concavity 9*f* in the vicinity of cog 9*d*. A spring 7 forces a ram 6 against the bottom of cog 9*d*. Both spring 7 and the stroke traveled by ram 6 are perpendicular to the weapon's beating and perpendicular to the plane of projection. Ram 6 accordingly exerts a torque on cam 9. The torque is smaller as long as cam 9 is relatively upright as represented in FIG. 2*a* for example and increases as the cam is pivoted counterclockwise to the position illustrated in FIG. 7*a* for example. Spring 7 also exerts a radial force component on cam 9. This radial component maintains the engagement between the cam and bolt 8. Attention is directed to FIGS. 2*a*, 4*a*, 5*a*, 6*a*, 7*a*, 8, 9, 10*a*, 10*b*, and 10*c* for the precise relation between ram 6 and cam 9.

The state-selection lever 10 in the embodiments illustrated by way of example in FIGS. 2 through 10*c* is mounted tight on shaft 5. It is similar in shape to a conventional safety-mechanism lever, rests against the outside of grip 1, and will be behind the lower edge of slide 4 in the assembled weapon. Lever 10 is not illustrated in FIGS. 1 and 1*a*.

Figure 3A:
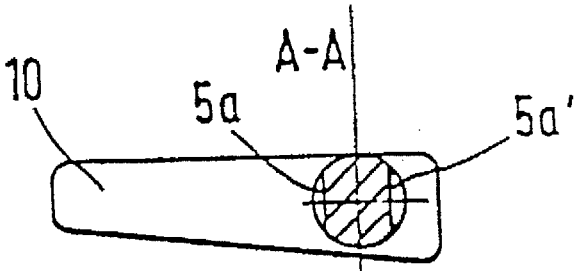
FIGS. 3*a* through 3*c* are sections along the lines A—A, B—B, and C—C in FIG. 3.
Figure 3B:
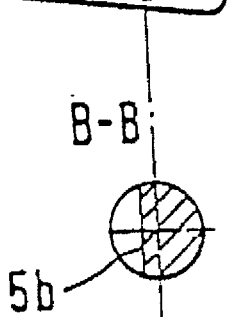
Figure 3C:
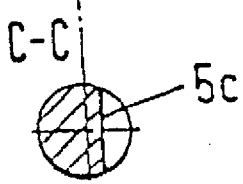

FIG. 3 is a top view of the assembly comprising state-selection lever 10 and shaft 5. Lever 10 is secured tight to and preferably integrated into the end of shaft 5 in this embodiment. FIGS. 3*a*, 3*b*, and 3*c* are sections through shaft 5 at lines A—A, B—B, and C—C in FIG. 3. Shaft 5 has flat sides 5*a* and 5*a*' at A—A, which is in the vicinity of state-selection lever 10. The particular mode-determinating cam 9 to be employed is installed at that section. Milled into the shaft at sections more remote from lever 10, are transverse recesses, a recess 5*b* at section B—B and a recess 5*c* at section C—C. Recesses 5*b* and 5*c* govern, in conjunction with other mechanisms, how the weapon is fired. Specifically, the aforesaid permanently integrated interacting components engage recesses 5*b* and 5*c* and accordingly assume or travel through various positions, transmitting motion to a downstream mechanism, which assumes various states and actuates the weapon.

The base of hammer 3 or 3' pivots on the cylindrical outer surface of shaft 5, specifically between recesses 5*b* and 5*c*.

State-selection lever 10 rotates shaft 5 to the extent allowed by the contour along the outer edge of mode-determinating cam 9. The contour accordingly dictates how far the cam can pivot. Each notch 9*c* along the contour provisionally arrests cam 9 and accordingly shaft 5 at a prescribed angle. The number of notches 9*c* dictates the number of angles. The position of the notches dictates the pivoting motion corresponding to the particular angle. Each individual cam 9 accordingly prescribes a particular group (number and type) of potential maneuver-and-employment modes.

The pistol can accordingly be rapidly converted from one maneuver-and-employment mode to another just by changing the cam. All the permanently integrated interacting components that participate in operating the pistol within a specific mode are already present in the pistol. This is in particular true of shaft 5 with its recesses 5*b* and 5*c* and state-selection lever 10. The permanently integrated interacting components remain in the weapon when it is converted from one mode to another. Only mode-determinating cam 9 is replaced with another that features another contour and system of notches 9*c*.

The embodiment illustrated in FIG. 1*a* has the same components as the embodiment illustrated in FIG. 2*a* with the exception of mode-determinating cam 9 and state-selection lever 10. Ram 6 and spring 7 are also superfluous. The shaft 5 in the embodiment illustrated in FIG. 1*a* also has flat sides 5*a* and 5*a*', although they are not necessary. Shaft 5 is also superfluous, unless the hammer is mounted on it, and the bores that it is mounted through can be plugged up. Journals can be employed instead of bores.

The embodiment illustrated in FIGS. 1 and 1*a* is intended only for use with a spring-tensioned trigger. The trigger is a stalker 3. Since it is subject to no manual intervention at all, it has no spur. It is released every time the weapon is loaded, and remains released. Since the safety mechanism is not absolutely necessary, it does not function.

Should a safety mechanism be considered desirable on the other hand, a mode-determinating cam 9 similar to the one illustrated in FIG. 2*a* will be mounted on shaft 5 at flat sides 5*a* and 5*a*'. The contour along the edge of this cam accommodates two notches 9*c*. A state-selection lever 10 is secured to the end of shaft 5. The pistol illustrated in FIGS. 2 and 2*a* is otherwise similar to that illustrated in FIGS. 1 and 1*a*. The precise shape and position, and particularly the angular positions, of notches 9*c* in relation to recesses 5*b* and 5*c* will be evident from the drawing.

Figure 4:
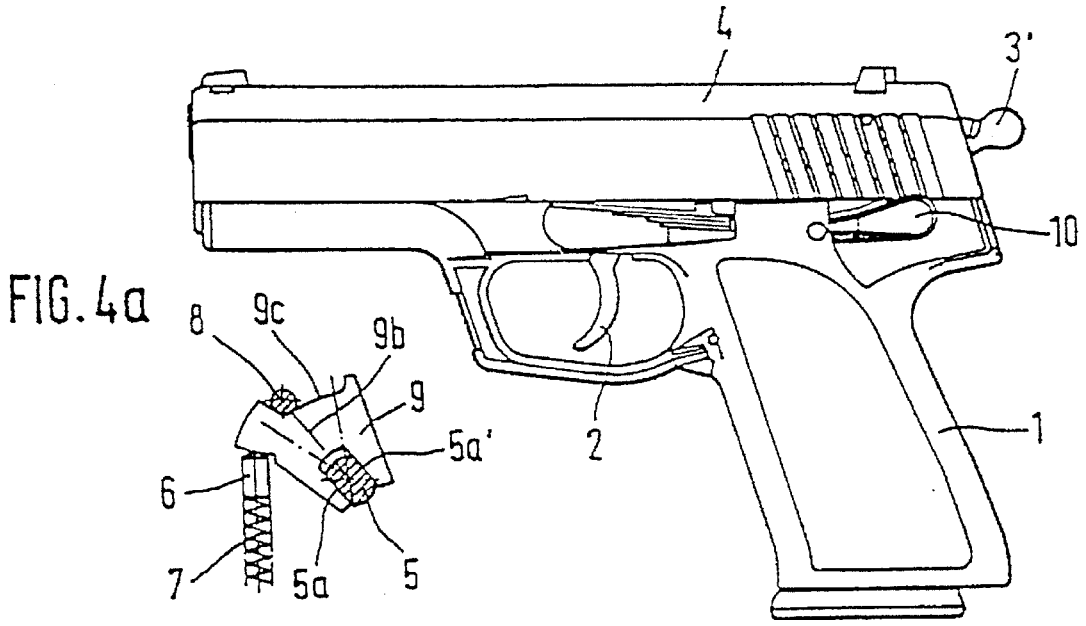
FIG. 4 is a side view of the pistol illustrated in FIG. 2 but with another version of the cam and with a different type of hammer.

FIG. 4 illustrates an embodiment of the pistol with a state-selection lever 10 and with a hammer 3' that can be cocked manually. FIG. 4*a* illustrates its mode-determinating cam 9. The design of this component differs from that of the cam illustrated in FIG. 2*a*. It permits operation in the states safety off, safety off and hammer uncocked (single-action), and uncocked. Uncocking releases the tension on hammer 3' either automatically or by means of trigger 2. The hammer will subsequently either move slowly forward, will be maintained in place by lever 10 and allowed to move slowly forward, or will impact against a stationary stop or the blocked striker.

The weapon illustrated in FIGS. 4 and 4*a* has no safety state.

Figure 5:
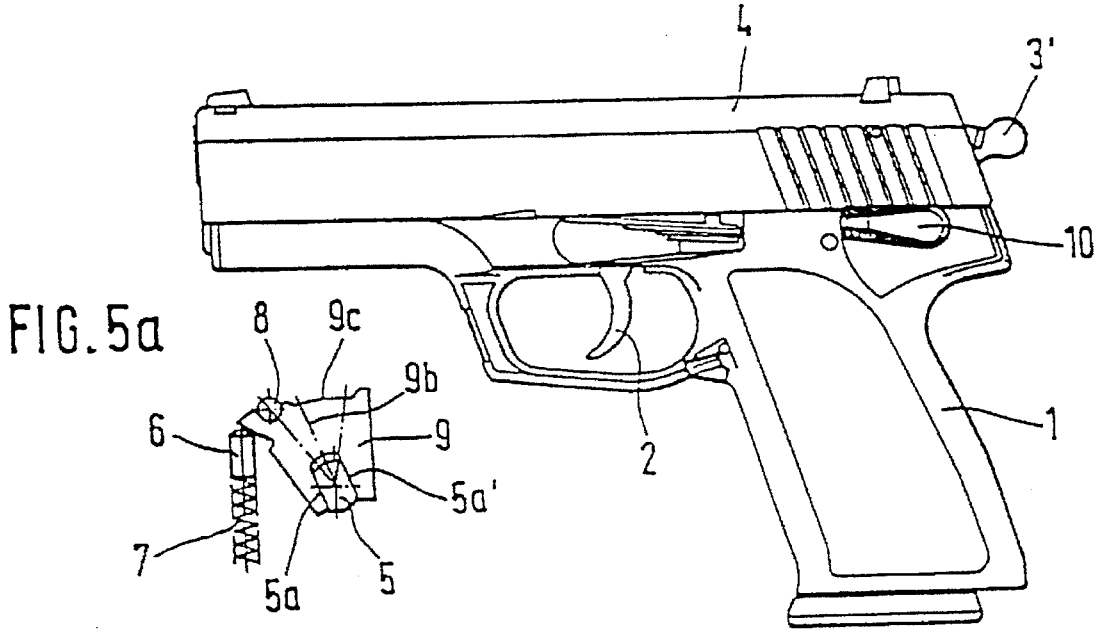
FIG. 5 is a side view of the pistol illustrated in FIG. 4 but with a third version of the cam in a particular setting.

FIGS. 5 though 7 illustrate a fourth embodiment in various operating states. This embodiment is outwardly similar to that illustrated in FIG. 4, although it has a different type of mode-determinating cam 9. The contour along the edge of this cam accommodates three notches 9*c*.

FIGS. 5 and 5*a* represent the pistol, like the pistol illustrated in FIG. 2, in the safety state selected by lever 10 and by mode-determinating cam 9. Lever 10 and accordingly the shaft and its recesses 5*b* and 5*c* are at the same angle in this state.

Figure 6:
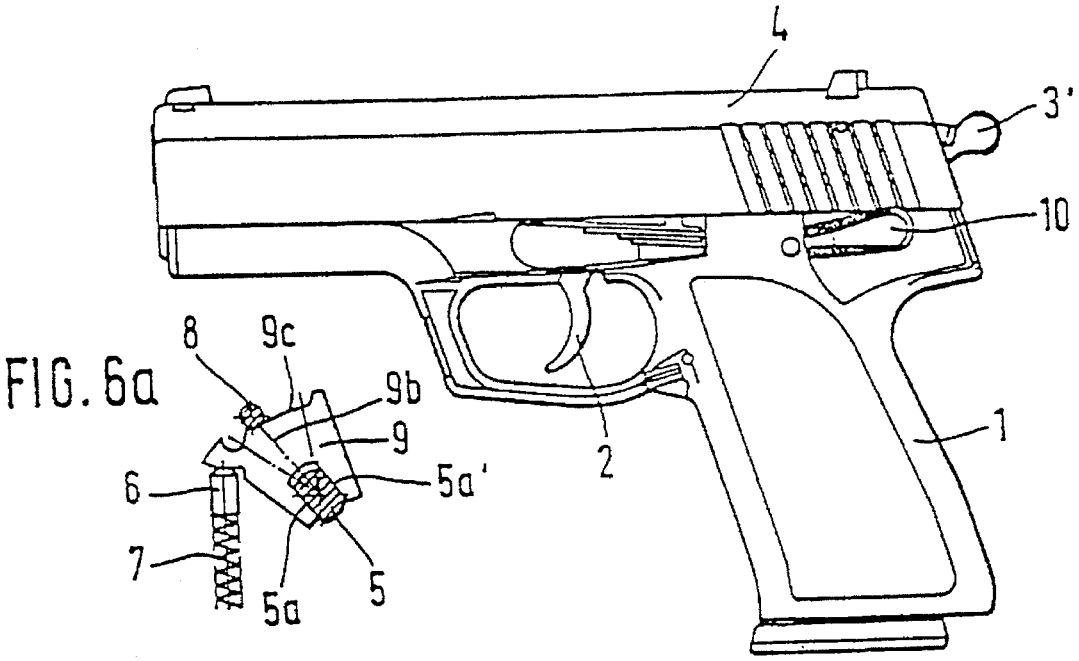
FIG. 6 is a side view of the pistol in FIG. 5 with the third version of the cam in another setting.

FIGS. 6 and 6*a* illustrate the pistol in the non-safety state selected by lever 10 and mode-determinating cam 9. With spring-loaded trigger 3' in the illustrated position, the pistol can be fired either by squeezing the tensioned trigger 2 (double-action) or by retracting trigger 3' into its seat and releasing it by means of trigger 2 (single-action).

The lever 10 in the embodiment illustrated in FIGS. 6 and 4 is rotated to the same extent as shaft 5.

Figure 7:
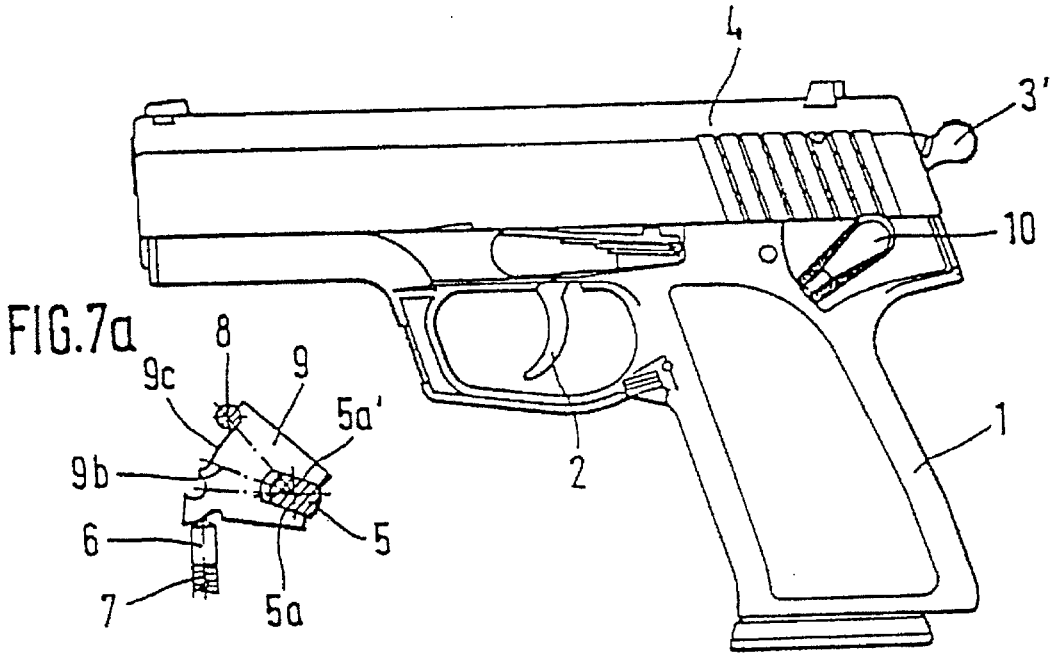
FIG. 7 is a side view of the pistol illustrated in FIG. 5 and illustrating the cam in a third setting.

FIGS. 7 and 7*a* illustrate lever 10 and cam 9 in a position that allows the weapon to be uncocked.

The weapon illustrated in FIG. 4 can be uncocked only by positioning its lever 10 as illustrated in FIG. 7.

Figure 8:
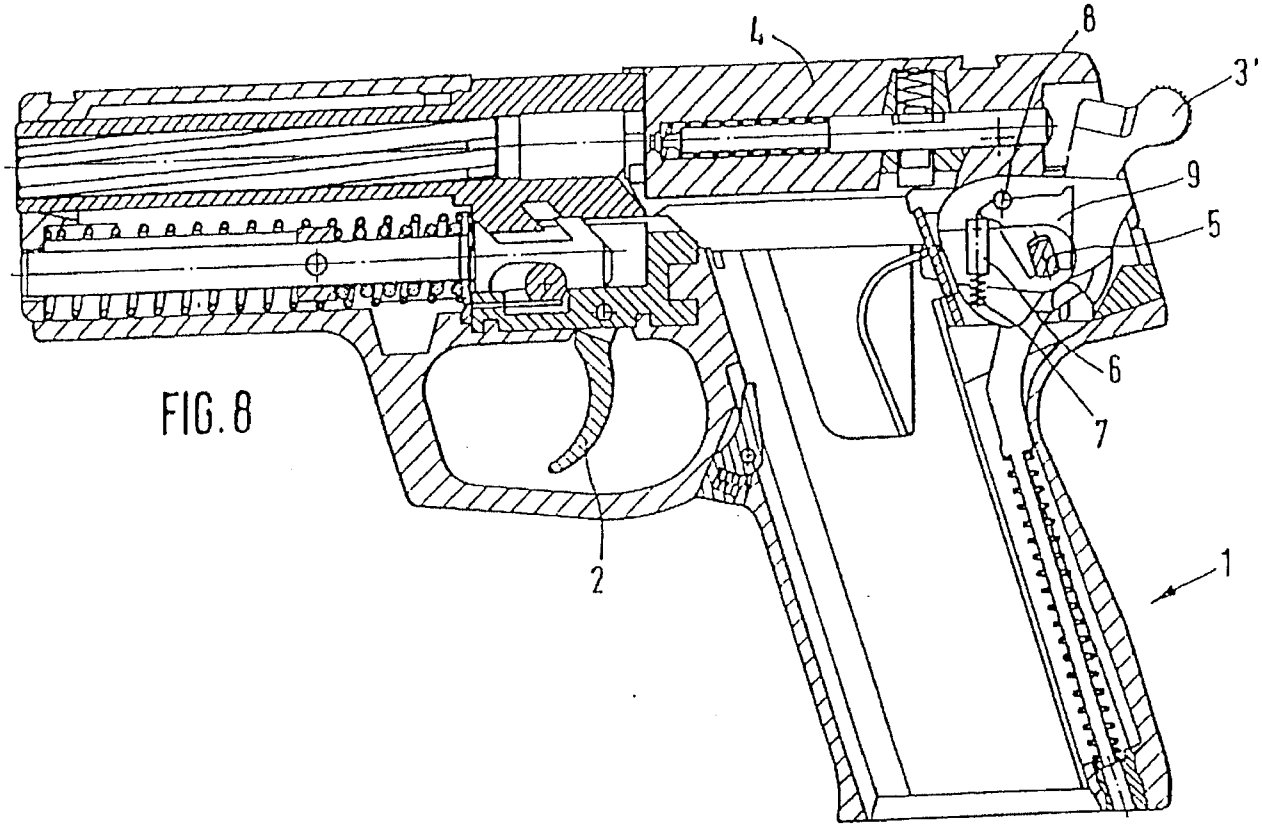
FIG. 8 is a longitudinal section through the pistol illustrated in FIG. 1 at approximately life size.

FIG. 8 is a detailed section through the pistol illustrated in FIG. 5.

Bolt 8 extends transversely through grip 1 and is secured in position by slide 4. Once slide 4 has been removed, bolt 8 can be forced to the right in the figure and out of grip 1, revealing mode-determinating cam 9. Cam 9 will now be forced radially up by spring 7 and ram 6 and can be removed.

The replacement cam 9 is now mounted on shaft 5, forced down with the finger, and held down with the index finger. The transverse bolt 8 is inserted again.

There can be a recess or head at one end of bolt 8 to allow its extraction without a tool.

An unillustrated mandrel-like projection on some other component could also function as a tool for displacing bolt 8. It is also possible to displace the bolt with the point of an easily extracted striker.

Figure 9:
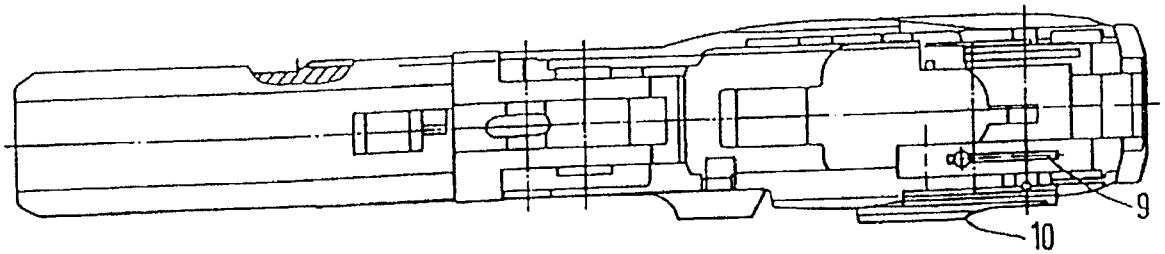
FIG. 9 is a top view of the pistol illustrated in FIG. 8 with the slide removed.

The top view of the grip 1 in FIG. 9 illustrates the exact position of mode-determinating cam 9 and that bolt 8 illustrated in FIG. 8 needs to be forced out of the grip only slightly to allow the cam to be interchanged.

Figure 10A:
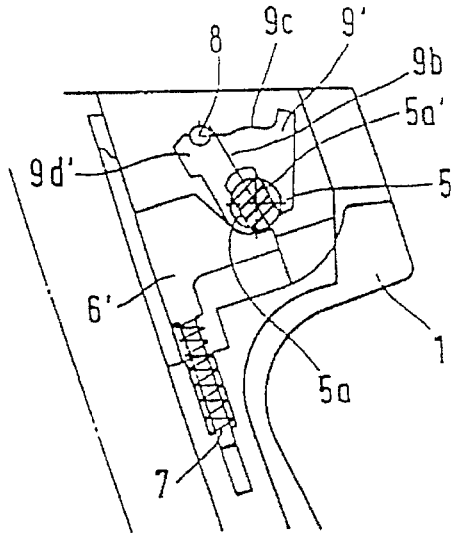
FIGS. 10*a* through 10*c* are sections similar to those in FIGS. 5*a*, 6*a*, and 7*a* through part of another embodiment of the pistol in accordance with the present invention with the cam in various settings.
Figure 10B:
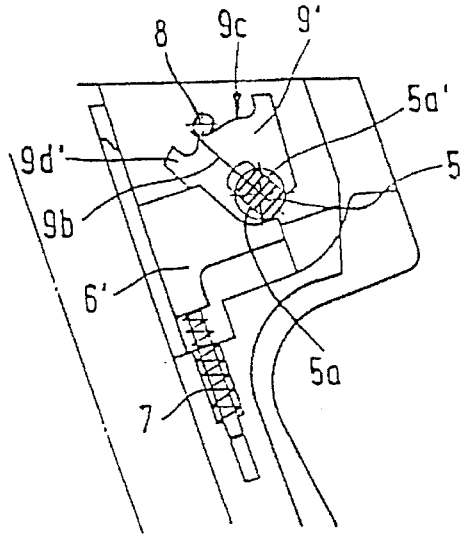
Figure 10C:
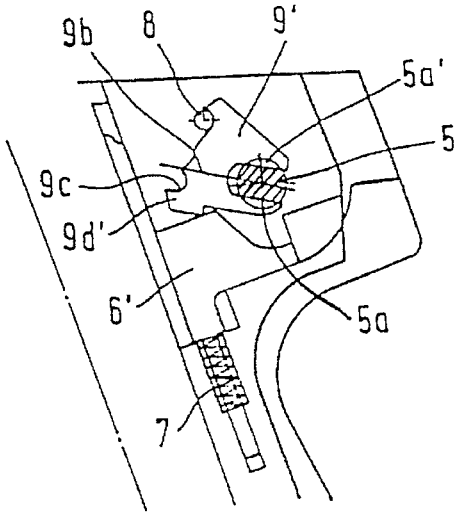

FIGS. 10*a* through 10*c* illustrate a ram 6' that differs from the ram 6 illustrated in the foregoing figures. The major difference is that the surface that rests against mode-determinating cam 9' matches the corresponding surface of the cam more precisely. This design differentiates between the cam's pivot and its engagement. Such a cam is more reliable.

Ram 6' is also easier to prevent from being forced out while mode-determinating cam 9' is being interchanged.

The interaction between ram 6' and mode-determinating cam 9' will be evident from FIGS. 10*a* through 10*c*. The versions illustrated in these figures are particularly essential.

The pivoting motion of mode-determinating cam 9 or 9' can basically alternatively be differentiated from its engagement by means of a compression spring between shaft 5 and the base of slot 9*a*.

In summary, weapons, semi-automatic weapons, and especially semi-automatic pistols, conventionally include several permanently integrated features, such as recesses 5*b* and 5*c*, that allow the weapon to operate in various maneuver-and-employment modes. An easily interchanged component, a mode-determinating cam 9 or 9' for example, can accordingly be exploited to determine what mode among those made possible by the permanently integrated features the user will set his weapon to use. The mode determinator, cam 9 or 9' for example, is, along with the component it is mounted on, shaft 5 for example, designed and accommodated such that it can easily be removed and replaced, especially with a different version either without disassembling the weapon at all or by disassembling it only into its major assemblies, grip 1 and slide 4. Cam 9 or 9' is mounted tight on a rotating shaft, the same shaft the base of the hammer is attached to for example, and can be removed from it. The edge of the mode determinator has a contour that accommodates notches 9*c* that correspond to specific angles of rotation of shaft 5. The notches engage a stationary component of the weapon, transverse bolt 8 for example, at those angles and can disengage from that component. The weapon's user can manually rotate shaft 5 by means of a conventional lever 10 secured to its end. The mode determinator, specifically cam 9 or 9', will arrest the shaft at, and can release it from, the rotations dictated by notches 9*c*. Only while they are at the particular angle will the recesses 5*b* and 5*c* in shaft 5 engage the permanently integrated interacting components and allow the weapon to be maneuvered and operated in the desired mode. A particular mode determinator will accordingly always position recesses 5*b* and 5*c* at a particular angle for engaging particular permanently integrated interacting components. The angles can be varied by interchanging the mode determinators.

FIGS. 11*a* through 13*c* illustrate various versions of another embodiment of a semiautomatic pistol equipped with maneuver-and-employ mode determinator in the form of an interchangeable mode-determinating cam 9".

Figure 12A:
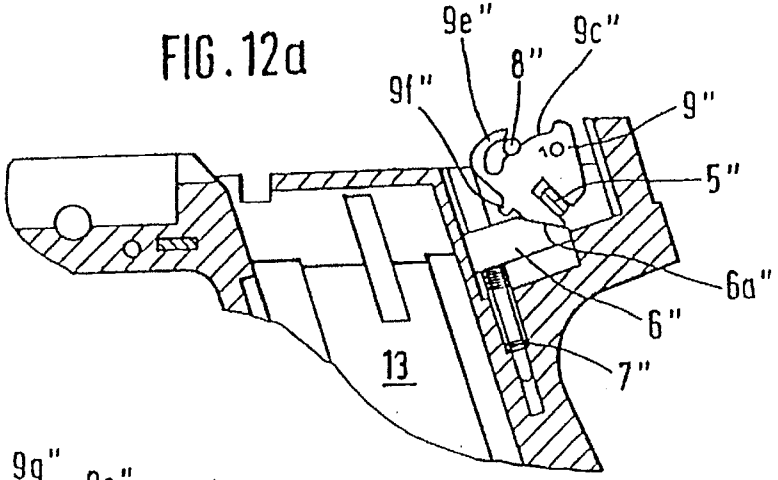
FIG. 12*a* is a similar broken longitudinal section through the grip of the embodiment in FIGS. 11*a* through 11*f* ready to fire.
Figure 13A:
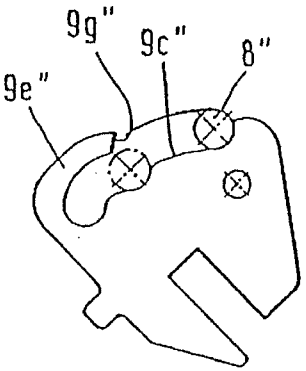
FIG. 13*a* illustrates the same embodiment illustrated in FIG. 13*a* in the same position with the trigger mechanism in and the cam out.
Figure 11A:
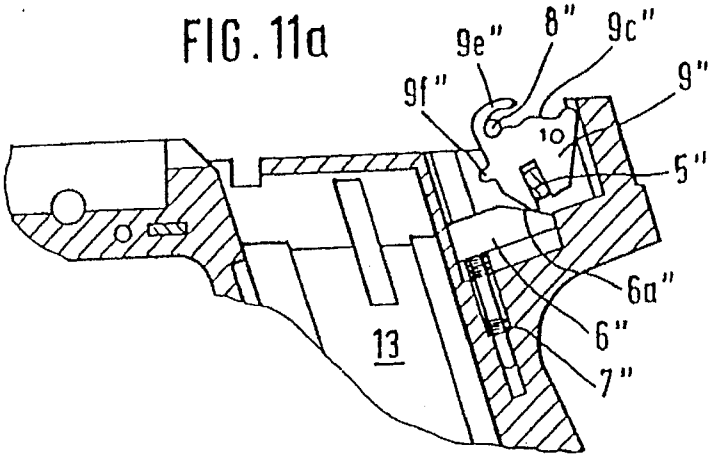
FIG. 11*a* is a broken longitudinal section through the grip of another embodiment of an automatic pistol, whereby of all the built-in components only the cam and the components directly associated with it, specifically in the safety position, are illustrated.
Figure 13:
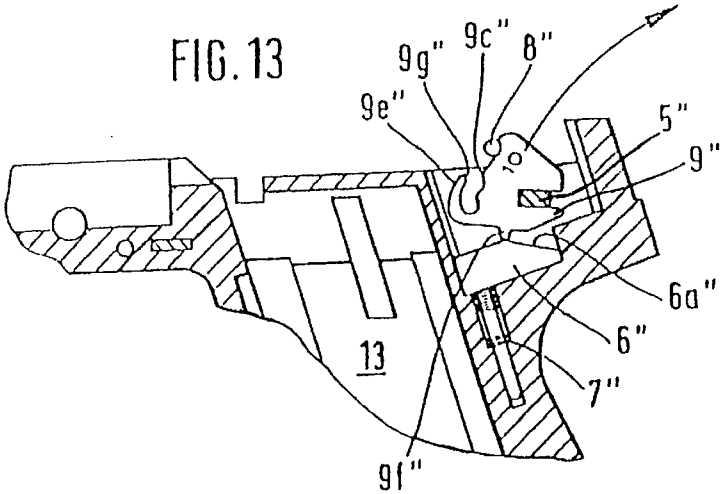
FIG. 13 is a similar broken section through the grip of the embodiment illustrated in FIGS. 11*a* through 12*f* uncocked along with a larger-scale detail of the cam.

FIGS. 11*a*, 12*a*, and 13 are broken longitudinal sections through a grip illustrating a mode-determinating cam 9" mounted on the same rotating shaft 5" the base of the hammer is fastened to, a ram 6" forced against the cam by a spring 7", and a bolt 8" that the spring also forces against the cam.

FIGS. 11*a* through 11*f* all illustrate the components in the safety position, FIGS. 12*a* through 12*f* illustrate them in the firing position, and FIGS. 13*a* through 13*f* illustrate them uncocked or being uncocked.

Cam 9" has a slot extending in from its lower edge. The slot fits over a section of shaft 5" that has two parallel flat sides or a flat-bottomed groove. The shaft also has a state-selection lever 10 of the type illustrated in FIG. 3 for example.

The ram 6" in the present invention is a thin sheet of metal with a contoured edge. The ram slides back and forth but does not rotate in a channel in grip 1. The ram has a flat bevel 6*a"* facing mode-determinating cam 9". When the pistol is in the ready-to-fire state illustrated in FIG. 12*a*, bevel 6*a"* rests flat against a matching bevel in the lower edge of cam 9". The overall mechanism is accordingly stable in the ready-to-fire state and can be removed from that state only by forcefully actuating the aforesaid lever. The weapon cannot be unintendedly jolted into the safety or uncocked state.

The upper edge of the mode-determinating cam is, like the one illustrated in FIGS. 10*a* through 10*c* equipped with a contour featuring notches 9*c"* that engage bolt 8".

The outermost notch, on the left in the figure, secures the mode-determinating cam in the safety position. The next notch governs the ready-to-fire state, and the fight-most contour is responsible for uncocking the pistol.

The two left-most notches are not introduced into the free upper edge of the mode-determinating cam but into the base of an arching slot, with both notches under an arching web 9*e"*.

The parallel bevels on shaft 5" essentially face the notch or slot associated with the ready-to-fire state. The adjacent edge of arching web 9*e"* faces shaft 5".

If the ready-to-fire pistol bounces hard enough off a supporting surface, when rested against a firm support while being fired for example, to briefly compress spring 7" due to the inertia of ram 6" and disengage mode-determinating cam 9" from bolt 8", the arching web on cam 9" will impact against it and spring back into the ready-to-fire position. An "automatic" entry into the safety state during firing or when the weapon is jolted will be impossible.

The matching bevel on mode-determinating cam 9" that rests against bevel 6*a"* when the pistol is in the ready-to-fire state illustrated in FIG. 12*a* extends far enough beyond shaft 5" to constitute a point. When the pistol is in the safety state illustrated in FIG. 11*a*, this point will rest against bevel 6*a"*, and ram 6" will exert a force on cam 9", restoring it to the ready-to-fire state.

This force will be counteracted by the engagement between the first (left-most) notch 9*c"* and bolt 8", maintaining the mode-determinating cam in the safety position. It takes, however, considerably less force to shift the cam into the non-safety position by means of the aforesaid lever than it takes to shift it into the safety position. Rapid and easy disestablishment of the safety state is accordingly possible even though it is unlikely that that state will come into being when the lever gets caught on a twig for example.

Since the notch that establishes the safety state is in the base of the slot demarcated by web 9*e"*, it will be impossible for mode-determinating cam 9" to be unintendedly pivoted out over the safety-state notch.

There is an impact surface 9*g"* facing the ready-to-fire notch at the open end of the slot illustrated in FIG. 13*a*. Impact surface 9*g"* extends at more or less of an angle to the axis of the slot.

Impact surface 9*g"* extends back and up from bolt 8" in the ready-to-fire position illustrated in FIG. 12*a*.

If the state-selection lever 10, illustrated in FIG. 2, on shaft 5" is released while the pistol is uncocked as illustrated in FIG. 13*a*, with bolt 8" resting against the rear of notch 9*c*", mode-determinating cam 9" will rush backward, entailing the risk that the ready-to-fire notch illustrated in FIG. 12*a* will be skipped.

This notch, however, is slightly offset in relation to that part of notch 9*c*" that channels the motion of mode-determinating cam 9" while the weapon is being uncocked.

As mode-determinating cam 9" rushes back it will accordingly impact in the vicinity of the ready-to-fire position notch as illustrated in FIG. 12*a* with impact surface 9*g*" against bolt 8" yielding its kinetic energy and slipping reliably into the ready-to-fire position. While it is engaging, it will be guided by impact surface 9*g*" as the latter slides along the outer surface of bolt 8".

It is accordingly impossible for the pistol to enter the safety state unintended.

Mode-determinating cam 9" also has a cog 9*f*" along its outer edge. In the safety and ready-to-fire positions, cog 9*f*" extends more or less at an angle to the path of ram 6" and fairly remote from shaft 5". It will accordingly be evident that, as the state-selection lever pivots cam 9" counterclockwise in the drawing, cog 9*f*" will engage the ram at an upper edge that extends across its path and will deflect along a considerable extent, specifically in resistance to considerable work on the part of spring 7". The lever will accordingly overcome the notch and swing to a considerable extent against a relatively powerful resilience, preventing negligent operation.

Once the lever has been released upon completion of this angle, once, that is, the right-hand end of the contour is resting against bolt 8" as illustrated in FIGS. 13 and 13*a*, notch 9" will rush back subject to the force of spring 7" but without skipping the ready-to-fire position illustrated in FIG. 12*a*, actually being reliably arrested in that position, especially by the collaboration between bevel 6*a*" and the matching bevel on cam 9".

Bolt 8" easily slides back and forth in a transverse bore through the grip and is secured in position once the pistol has been assembled by the lower edge of the slide 4 illustrated in FIG. 1.

Once slide 4 has been removed, bolt 8 can be displaced until mode-determinating cam 9" is released and can be extracted upward from the flattened section of shaft 5".

Mode-determinating cam 9 can then be replaced with another one (not illustrated) that features only the safety and ready-to-fire position notches but not the uncocking notch 9*c*" in the contour on the right side of the figure.

The mechanism just specified is completely independent of the actual trigger mechanism, which will now be specified with reference to FIGS. 11*a* through *f*, 12*a* through *f*, 13, 13*a* and 13*b*.

A trigger 12 pivots on a pin in front of the magazine cavity 13 in the grip as illustrated in FIG. 11*b* and extends upward. A trigger rod 10 is articulated to the end of the upward extension and extends to the left above magazine cavity 13 and back along the grip. Behind magazine cavity 13, the trigger rod bends down and then across the length of the pistol. The end 11 of the trigger rod is illustrated in section in FIGS. 11*c*, 11*d*, and 12*c*.

End 11 is intended by the way as will be specified hereinafter to engage a depression in the bottom of hammer 3" and tension it by applying traction to trigger 12.

Figure 12C:
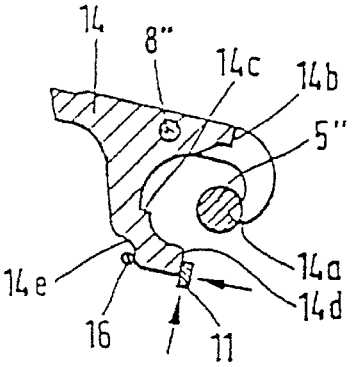
FIGS. 12*c* through 12*f* illustrate separate components of the trigger mechanism of the embodiment illustrated in FIGS. 11*a* and 11*b*.
Figure 11D:
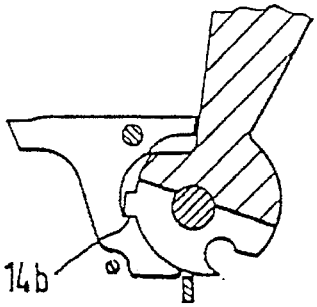

One or more unillustrated springs apply force to the trigger and trigger rod, forcing trigger 12 forward and trigger rod 10 backward and its end back and up in the direction indicated by the arrows in FIG. 12*c*. The spring acts in the direction indicated by the perpendicular arrow and opposite the direction indicated by the horizontal arrow.

Behind the magazine cavity 13 inside the grip is a series of adjacent components distributed along bolt 8 from the left to the fight (as viewed from the top in FIG. 9), specifically an unillustrated interrupter, an interceptor 14, and a release 15. Behind them and resting on shaft 5" are the aforesaid interrupter, hammer 3", and mode-determinating cam 9" in the same sequence.

Hammer 3", interceptor 14, and release 15 are each composed of two separate parts positioned adjacent across the pistol.

The unillustrated interrupter constitutes a sheet of metal that travels up and down in a slot penetrated by bolt 8". It rests on trigger rod 10 and incorporates a mode-determinating cam that projects up beyond the grip. A structure on the slide 4 illustrated in FIG. 8 comes into contact with the cam during recoil and forces it down along with the interrupter and hence trigger rod 10 until its end 11 disengages from interceptor 14 as will be specified hereinafter.

Figure 11C:
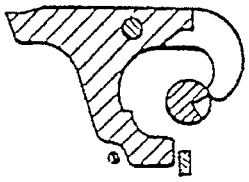
FIGS. 11*c* through 11*f* illustrates separate components of the trigger mechanism in the embodiment illustrated in FIGS. 11*a* and 11*b* in position.

The half of the interceptor 14 that is to the fight as the weapon is sighted is shaped overall like a three-quarters-of-a-circle ring with facing terminating edges 14*a* and 14*d*, a detention bar 146 extending into the ring, and a release surface 14*e*. The arm that terminates in terminating edge 14*a* on the right is much shorter on the left side, as the weapon is sighted, of the interceptor (hatched in FIGS. 11*c* and 12*c*) and terminates in an interceptor surface 14*c*. Attention is directed to FIGS. 11*c* and 12*c* in particular.

The right half of interceptor 14 (represented by the total outline of the interceptor in FIGS. 11*c* and 12*c*) engages beyond hammer 3" on the right, and has a downward-lifted end with a terminating edge 14*a* that points down and forward and rests in the safety position or as long as trigger 12 is not actuated against the outer edge of shaft 5".

At the point of contact, shaft 5" has the groove obvious from FIGS. 11*c* and 12*c* and oriented in the safety position illustrated in FIG. 11*c* facing away from terminating edge 14*a* as long as shaft 5" is in the ready-to-fire position as illustrated prior to firing in FIG. 12*c*.

Comparison of FIGS. 11*c* and 12*c* will definitely reveal that, in the ready-to-fire position illustrated in FIG. 12*c*, interceptor 14 can pivot around bolt 8" with terminating edge 14*a* entering the aforesaid groove in shaft 5". In the safety position illustrated in FIG. 11*c*, however, such a pivoting motion is impossible because the groove is pivoted away from terminating edge 14*a*.

The end 11 of trigger rod 10 rests against terminating edge 14*d*. When the trigger is pulled, end 11 will move in the direction indicated by the horizontal arrow in FIG. 12*c* and will pivot interceptor 14, which is of course possible only in the ready-to-fire position illustrated in FIG. 12*c*.

In the vicinity of the right-hand side of the hammer 3" illustrated in 11*d* and 12 is a cog, the bottom of which is intercepted by detention bar 14*b*. The cog can only travel past detention bar 14*b* once interceptor 14 has swung out of the way, when, that is, trigger 12 is pulled as illustrated in FIG. 12*d*.

The purpose of interceptor surface 14*c* is to prevent hammer 3" from striking too far forward and jamming when it is allowed to strike once the slide has been removed and the trigger mechanism shifted out of the safety position. Interceptor surface 14*c* constitutes as will be evident from FIG. 12*d* a terminal limit for the hammer.

A transverse pin 16 is positioned in front of the aforesaid interceptor 14. When the end 11 of trigger rod 10 forces the interceptor in the sense represented as clockwise in the figure, release surface 14*e* will force transverse pin 16 forward.

Figure 12D:
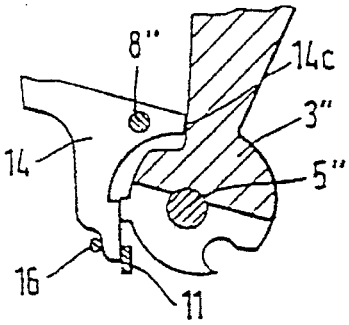
Figure 11E:
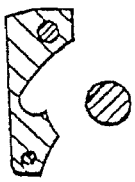

An unillustrated spring constantly forces interceptor 14 back out of the pivoted-in position illustrated in FIG. 12*d* and into the position illustrated in FIG. 12*c*, which is its initial position. When a shot is fired, the aforesaid interrupter forces the end 11 of trigger rod 10 down below the lower edge of the interceptor and permits it to pivot back into its initial position even though the trigger remains tensioned. If the trigger is subsequently released, end 11 will travel back below terminating edge 14*d* and then up in the direction indicated by the perpendicular arrow in FIG. 12*c* until it assumes the position illustrated in FIG. 12*c*.

Figure 12E:
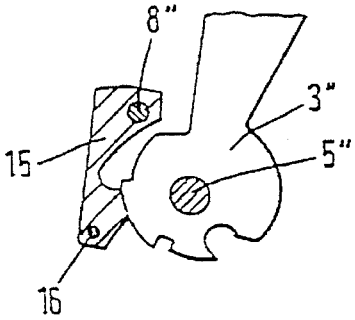

Transverse pin 16 rests in release 15. The half of release 15 that is on the right in FIGS. 11*e* and 12*e* has a detaining edge that interacts with a countervailing edge in the left half of hammer 3 and constitutes in conjunction with it the major detent of the trigger mechanism as illustrated in FIG. 12*e*.

The release also pivots around bolt 8", counterclockwise in the drawing, subject to an unillustrated spring, maintaining the detaining edge below the countervailing edge. When on the other hand trigger 12 is pulled and transverse pin 16 is forced forward, the release will pivot clockwise, the detaining edge will be lifted over the countervailing edge, and the hammer will strike.

Figure 11F:
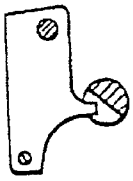
Figure 12F:
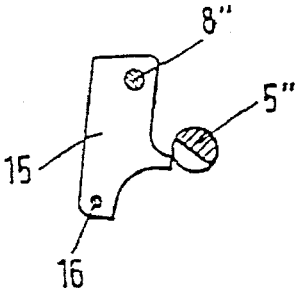

The half of release 15 that is on the left in FIGS. 11*f* and 12*f* has a projection that enters a flat-bottomed recess in shaft 5". When shaft 5" is rotated counterclockwise out of the angle illustrated in FIG. 12*f*, the groove will move out of the position illustrated in FIG. 12*c* until terminal edge 14*a* can no longer enter it and interceptor 14 will no longer be able to pivot. The projection of release 15 will be forced down, pivoting the release clockwise. The detaining edge will be lifted away from the countervailing edge and the hammer will strike, but only until its interceptor cog comes into contact with the detention bar 14*b* on interceptor 14. It will accordingly be impossible for the hammer to complete the strike, and no shot will be fired.

The double-action mechanism is not illustrated herein. It comprises a structure on trigger rod 10 that engages behind another structure on hammer 3", and is tensioned as the rod advances.

The left half of the hammer features in addition to the countervailing edge an intercepting detent that is for simplicity's sake not illustrated in the drawing. The intercepting detent maintains hammer 3" at an angle that corresponds to the engagement of detention bar 14*b* with the cog on the hammer.

What is claimed is:

1. A semiautomatic firearm, comprising a removable slide, a grip, a rotatable shaft, a moveable bolt, a spring-mounted ram, and an interchangeable mode determinator for selectively controlling a mode of operation of the pistol, wherein the bolt extends transversely through the grip and is secured into position by the slide, and wherein the interchangeable mode determinator is disposed on the rotatable shaft, and wherein the rotatable shaft extends through the grip and is positioned between the spring-mounted ram and the moveable bolt; and the mode determinator may be interchanged by removing the slide and moving the bolt.

2. The semiautomatic firearm as in claim 1, further comprising a selection lever disposed on the rotatable shaft and wherein the mode determinator comprises a cam, and further wherein the shaft may be moved by pivoting the selection lever, thereby pivoting the mode determinator into different positions in relation to the spring-mounted ram and bolt.

3. The semiautomatic firearm as in claim 2, further comprising a hammer having a base, wherein the base is secured to the shaft and the hammer may be cocked or uncocked.

4. The semiautomatic firearm as in claim 3, wherein the shaft has a flat section and the cam is mounted on the flat section.

5. The semiautomatic firearm as in claim 4, wherein the cam comprises an outer lobe having at least one notch for engaging with the bolt, the engagement representing a mode.

6. The semiautomatic firearm as in claim 4, wherein the cam may be moved radially against the force of the spring-mounted ram.

7. The semiautomatic firearm as in claim 5, wherein the cam is sector-shaped and forms a cog at one end of the lobe, the cog presses against the spring-mounted ram, which asserts a tangential and/or radial force on the cog.

8. The semiautomatic firearm as in claim 5, wherein the cam comprises two notches disposed along the lobe and the bolt may engage in either notch by pivoting the cam between two modes, one designated as a safety mode, the other as a ready mode.

9. The semiautomatic firearm as in claim 8, wherein the two notches comprise one short notch and one long notch for engaging with the bolt, the cam may be pivoted between three modes, non-safety mode with hammer uncocked, non-safety mode, and uncocked mode.

10. The semiautomatic firearm as in claim 5, wherein the lobe comprises three notches, two shorter notches followed by one longer notch, disposed along the lobe, providing pivoting of the cam between four modes, safety, non-safety and hammer uncocked, non-safety, and uncocked.

* * * * *